US007611026B1

(12) United States Patent
Bloom et al.

(10) Patent No.: US 7,611,026 B1
(45) **Date of Patent: *Nov. 3, 2009**

(54) TAMPER-EVIDENT CLOSURE HAVING A SEALING DISK AND PACKAGE FOR HIGH-TEMPERATURE APPLICATIONS

(75) Inventors: Kenneth S. Bloom, Bloomdale, OH (US); Stephen A. Eilertson, Perrysburg, OH (US); Maurice R. Gnepper, Fremont, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 632 days.

This patent is subject to a terminal disclaimer.

(21) Appl. No.: 11/150,373

(22) Filed: Jun. 10, 2005

Related U.S. Application Data

(60) Continuation-in-part of application No. 11/017,179, filed on Dec. 20, 2004, now Pat. No. 7,147,118, which is a division of application No. 10/217,691, filed on Aug. 12, 2002, now Pat. No. 6,874,647.

(51) Int. Cl.
*B65D 45/30* (2006.01)
*B65D 53/00* (2006.01)
*B65D 41/32* (2006.01)

(52) U.S. Cl. ..... 215/276; 215/341; 215/349; 215/350; 215/351; 215/252

(58) Field of Classification Search ..... 215/276, 215/349–351, 252, 341, 307, 346, 352
See application file for complete search history.

(56) References Cited

U.S. PATENT DOCUMENTS 2,456,607 A 12/1948 Stewart
2,619,246 A 11/1952 Staller (Continued)

FOREIGN PATENT DOCUMENTS

FR 1152487 2/1958

(Continued)

*Primary Examiner*—Robin A. Hylton
(74) *Attorney, Agent, or Firm*—Reising Ethington PC

(57) ABSTRACT

A plastic closure includes a plastic closure shell having a base wall with a central opening, a skirt for securing the closure to a container neck finish, and an internal ledge on the skirt adjacent to but spaced from the base wall. A plastic disk is retained within the closure shell. The disk includes a plurality of axially extending spacer elements, preferably in the form of angularly spaced circumferentially aligned bead segments around a peripheral portion of the disk, to engage an underside of the base wall and space the disk from the base wall of the shell. Angular gaps between the spacer elements permit flow of fluid from the central opening, between the base wall and the disk and through the gaps. A periphery of the disk is disposed between the internal ledge on the skirt and the base wall of the shell to capture the disk such that the disk is free to rotate within the shell. A resilient sealing liner is molded onto an underside of the disk for sealing engagement with the container neck finish. The internal ledge on the skirt preferably includes at least one radially inwardly opening axially extending drain slot to permit flow of fluid around the periphery of the disk and through the slot in the ledge.

12 Claims, 2 Drawing Sheets

U.S. PATENT DOCUMENTS

| | | | | |
|---|---|---|---|---|
| 3,434,615 | A | | 3/1969 | Barletta |
| 3,612,325 | A | * | 10/1971 | Williams ..... 215/329 |
| 3,709,395 | A | | 1/1973 | Brennan |
| 3,760,969 | A | | 9/1973 | Shimamoto et al. |
| 3,924,772 | A | | 12/1975 | Magnani |
| 4,128,184 | A | | 12/1978 | Northup |
| 4,405,054 | A | | 9/1983 | Braun |
| 4,554,125 | A | | 11/1985 | Knapp |
| 4,723,678 | A | | 2/1988 | Kollen et al. |
| 4,747,500 | A | | 5/1988 | Gach |
| 4,813,561 | A | | 3/1989 | Ochs |
| 4,880,127 | A | | 11/1989 | Doi |
| 5,031,787 | A | | 7/1991 | Ochs |
| 5,078,290 | A | | 1/1992 | Ochs |
| 5,158,194 | A | | 10/1992 | Sirgo |
| 5,314,084 | A | | 5/1994 | Folta et al. |
| 5,346,082 | A | | 9/1994 | Ochs |
| 5,579,936 | A | | 12/1996 | Costa et al. |
| 5,819,968 | A | | 10/1998 | Jones |
| 5,868,264 | A | | 2/1999 | Fulford et al. |
| 5,950,638 | A | | 9/1999 | Crosta |
| 5,984,124 | A | | 11/1999 | Takano |
| 6,142,325 | A | | 11/2000 | Chomik |
| 6,276,543 | B1 | | 8/2001 | German |
| 6,371,318 | B1 | | 4/2002 | Riffer |
| 6,399,170 | B1 | | 6/2002 | Hock |
| 6,868,978 | B2 | | 3/2005 | Amschlinger |
| 6,874,647 | B2 | * | 4/2005 | Bloom et al. ..... 215/276 |
| 7,147,118 | B2 | * | 12/2006 | Bloom et al. ..... 215/276 |
| 2003/0098286 | A1 | | 5/2003 | Bloom et al. |
| 2004/0108294 | A1 | | 6/2004 | Eilerston et al. |

FOREIGN PATENT DOCUMENTS

| | | |
|---|---|---|
| GB | 872981 | 7/1961 |
| GB | 884173 | 12/1961 |
| JP | 10152156 | 6/1998 |

* cited by examiner

TAMPER-EVIDENT CLOSURE HAVING A SEALING DISK AND PACKAGE FOR HIGH-TEMPERATURE APPLICATIONS

This application is a continuation-in-part of application Ser. No. 11/017,179 filed Dec. 20, 2004, now U.S. Pat. No. 7,147,118 which is a division of application Ser. No. 10/217,691 filed Aug. 12, 2002 and now U.S. Pat. No. 6,874,647.

The present disclosure relates to plastic closures for beverage, food, juice, pharmaceutical and like applications, and more particularly to a closure, a package and a method of manufacture that are particularly well suited for high-temperature applications such as pasteurization, hot-fill and retort applications.

BACKGROUND AND SUMMARY OF THE DISCLOSURE

It has been proposed to provide a plastic closure for a container, which includes a plastic cap or shell with an interior liner for sealing engagement with a sealing surface of the container neck finish. For example, U.S. Pat. No. 4,984,703 discloses a plastic closure that comprises a shell having a base wall with a peripheral skirt and an internal thread for securing the closure to a container neck finish, and a sealing liner compression molded in situ on the interior of the shell base wall. U.S. Pat. No. 5,451,360 discloses a method and apparatus for compression molding the liner in situ within the closure shell. It also has been proposed to provide plastic resin barrier materials within the sealing liner for resisting transmission of gases (e.g., carbon dioxide and oxygen), water vapor and/or flavorants through the liner. For example, U.S. Pat. No. 6,371,318 discloses a plastic closure and method of manufacture in which a liner is compression molded in situ on the interior surface of the closure base wall, and includes a multiplicity of alternating layers of matrix polymer such as EVA and barrier polymer such as EVOH. U.S. Pat. No. 6,399,170 discloses a plastic closure and method of manufacture in which the liner is compression molded in situ on the interior surface of the closure base wall and includes a dispersion of barrier polymer platelets, such as EVOH, dispersed within matrix polymer such as EVA.

It is desirable to provide a closure and liner construction, a method of closure manufacture, and a closure and container package that are particularly well adapted for high-temperature applications. Such high-temperature applications include, for example, so-called hot-fill applications in which the container is filled with product while the product is hot. High-temperature applications also include applications in which the filled package is subjected to pasteurization or retort after filling. During retort applications, for example, the filled package may be subjected to a temperature of 265° F. for fifteen minutes. High-temperature situations also can occur when a package is filled with a carbonated beverage and subjected to storage under high-temperature conditions, in which the internal pressure within the container can increase dramatically. In all of such high-temperature situations, the container closure is subjected to elevated internal pressure that tends to distort or dome the closure base wall and lift the sealing liner away from sealing engagement with the container neck finish.

U.S. Patent Document 2003/0098286 discloses a plastic closure that has particular utility for such high temperature applications. The closure includes a shell having a base wall and a skirt with one or more internal thread segments for securing the closure to a container neck finish. In some embodiments, a plastic disk is loosely captured within the closure shell. An annular ring extends axially from the disk adjacent to but spaced from the periphery of the disk. A resilient liner is molded onto the disk over at least the central portion of the disk and over the ring on the disk. The ring urges the liner into sealing engagement with the radially inner edge and the axial end of the container neck finish when the closure is secured to the container finish. In some embodiments of the closure disclosed in the noted patent document, the disk includes an annular rib around the periphery of the disk, with the liner extending around the inner periphery of the rib. The disk in these embodiments thus urges the liner into sealing engagement with the inner and outer edges of the container neck finish as well as the axial end of the container neck finish. When a filled package that includes such a closure is subjected to elevated temperatures, during retort applications for example, the liner is maintained in sealing contact with the container finish.

Although the closure, package and method of manufacture disclosed in the noted patent document address and overcome problems theretofore extant in the art, further improvements remain desirable. In particular, in embodiments in which the liner is disposed on a separate disk retained within the closure shell, there are concerns associated with potential accumulation of debris and/or liquid product in the space between the disk and the base wall of the closure shell and/or between the closure skirt and the container finish, which can promote growth of mold or other undesirable matter. It therefore is a general object of the present disclosure to provide a closure, a closure and container package, and a method of manufacture that include facility for flushing the area between the closure shell and the liner disk and/or between the closure skirt and the container neck finish after the closure has been assembled to the container.

The present disclosure embodies a number of aspects that can be implemented separately from or in combination with each other.

A plastic closure in accordance with one aspect of the present disclosure includes a plastic closure shell having a base wall with a central opening, a skirt for securing the closure to a container neck finish, and an internal ledge on the skirt adjacent to but spaced from the base wall. A plastic disk is retained within the closure shell. The disk includes a plurality of axially extending spacer elements, preferably in the form of angularly spaced circumferentially aligned bead segments around a peripheral portion of the disk, to engage an underside of the base wall and space the disk from the base wall of the shell. Angular gaps between the spacer elements permit flow of fluid from the central opening, between the base wall and the disk and through the gaps. A periphery of the disk is disposed between the internal ledge on the skirt and the base wall of the shell to capture the disk such that the disk is free to rotate within the shell. A resilient sealing liner is molded on an underside of the disk for sealing engagement with the container neck finish. The internal ledge on the skirt preferably includes at least one radially inwardly opening axially extending drain slot to permit flow of fluid around the periphery of the disk and through the slot in the ledge.

A closure and container package in accordance with another aspect of the present disclosure includes a container having a neck finish and a plastic closure secured to the container neck finish. A method of making a closure and container package in accordance with yet another aspect of the present disclosure includes providing a glass or plastic container having a neck finish with at least one external thread segment, and a closure that includes a shell with a skirt having at least one internal thread segment. The closure shell has a base wall with a central opening, and a disk is retained within the shell parallel to but separate from the base wall of the closure. The disk includes a plurality of angularly spaced axially extending spacer elements around the disk in abutting engagement with the base wall of the closure shell spacing the disk from the base wall. Angular gaps between the spacer elements permit flow of fluid from the central opening, between the base wall and the disk, through the gaps and around the edge of the disk. The disk has a periphery disposed between the base wall and an internal ledge on the skirt of the closure shell to capture the disk within the said shell such that the disk is free to rotate within the shell. A resilient liner is molded onto an underside of the disk for sealing engagement with the container neck finish. The container is filled with a fluid product, and the closure is secured to the container with the liner in sealing engagement with the neck finish. The closure is then flushed by directing fluid into the base wall opening, between the base wall and the disk, through the gaps between the spacer elements, and then past the periphery of the disk between the skirt and the neck finish.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

The disclosure of above-noted U.S. application Ser. No. 11/017,179 is incorporated herein by reference.

Figure 1:
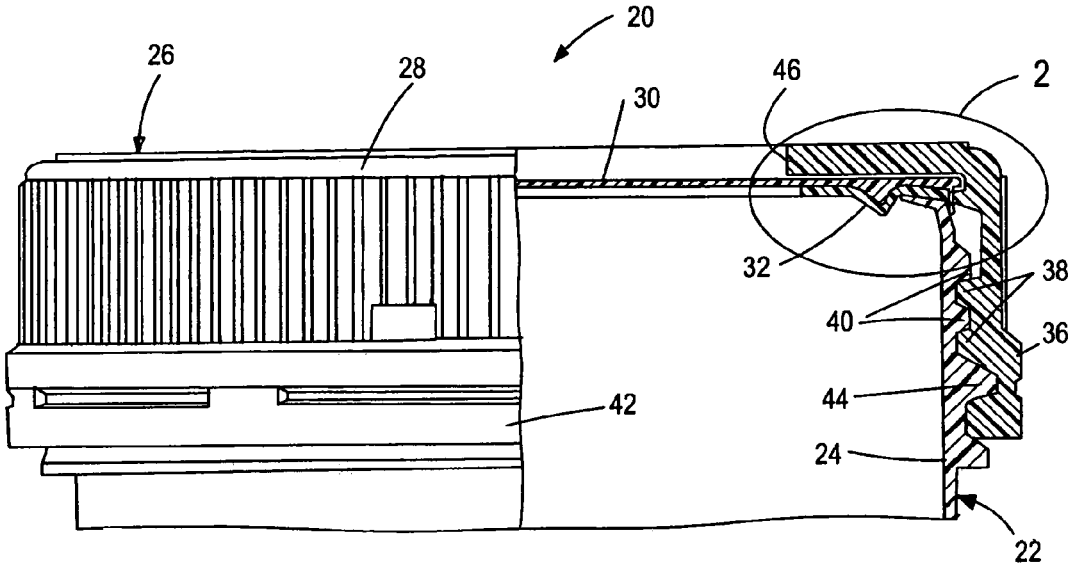
FIG. 1 is a partially sectioned fragmentary elevational view of a closure and container package in accordance with one exemplary embodiment of the present disclosure.
Figure 2:
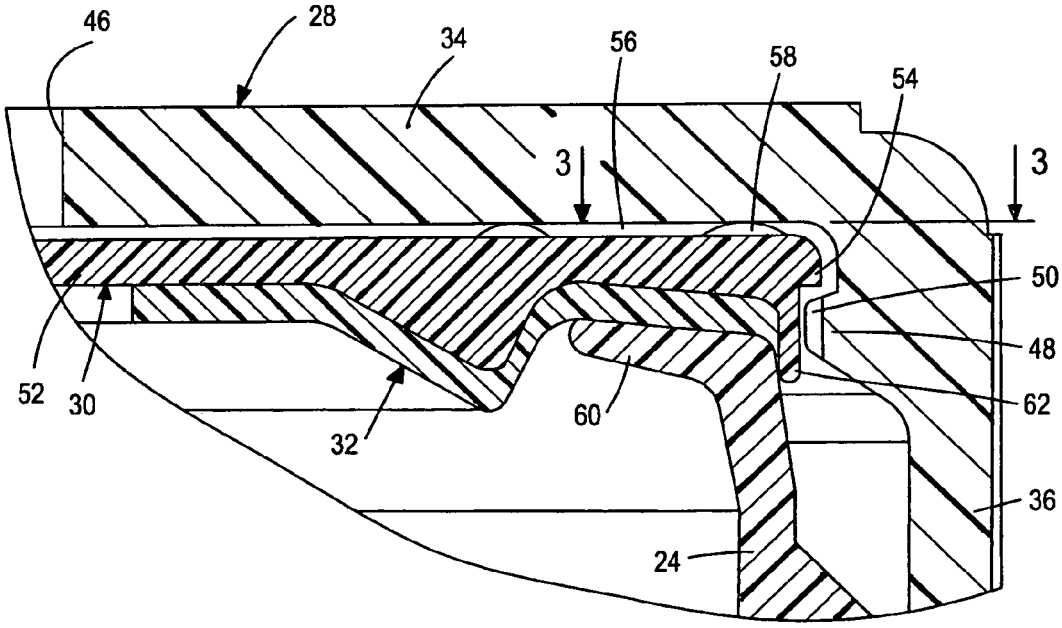
FIG. 2 is a fragmentary sectional view on an enlarged scale of the portion of FIG. 1 within the area 2.

The drawings of the present application illustrate a closure and container package 20, in accordance with an exemplary embodiment of the present disclosure, as including a container 22 having a cylindrical neck finish 24. A closure 26 is externally secured to container neck finish 24. Closure 26 is an assembly that includes a closure shell 28, a liner disk 30 and a sealing liner 32. Closure shell 28 includes a base wall 34 and a skirt 36 with one or more internal thread segments 38 for engagement with one or more external thread segments 40 on container neck finish 24. (The term "thread segment" is employed in its usual broad sense to include both continuous and interrupted threads, and both complete and partial threads.) Closure skirt 36 and container neck finish 24 alternatively may include one or more beads for securement of the closure to the container, although engaging thread segments are currently preferred. It also is contemplated that closure shell 28 may comprise a dual-wall shell that has an inner wall or skirt with internal thread segments 38 and an outer wall or skirt to coordinate with the contour of the sidewall of the container. Closure shell 28 preferably also includes a tamper-indicating band 42 (FIG. 1) frangibly connected to the lower edge of skirt 36 for cooperating with an external bead 44 on neck finish 24 wholly or partially to separate band 42 from skirt 36 and thereby provide an indication that the package has been opened. (Directional words such as "upper" and "lower" are employed by way of description and not limitation with respect to the upright orientation of the package illustrated in FIGS. 1 and 2. Directional words such as "axial" and "radial" are employed by way of description and not limitation with respect to the axis of the container neck finish or the closure skirt as applicable.)

Closure base wall 34 has a through-opening 46 that preferably is centrally disposed and coaxial with skirt 36. An internal ledge 48 is disposed on skirt 36 at a position adjacent to but spaced from the undersurface of base wall 34. Ledge 48 has an upper surface, opposed to the undersurface of base wall 34, that preferably lies in a plane perpendicular to the axis of skirt 36. Ledge 48 has at least one radially inwardly opening axially extending drain slot 50 at the inner periphery of the ledge. Slot 50 may be of any suitable contour, and of any suitable radial depth toward the radially inner surface of skirt 36. There preferably are a plurality of drain slots 50 disposed at angularly spaced locations around the inner periphery of ledge 48.

Figure 3:
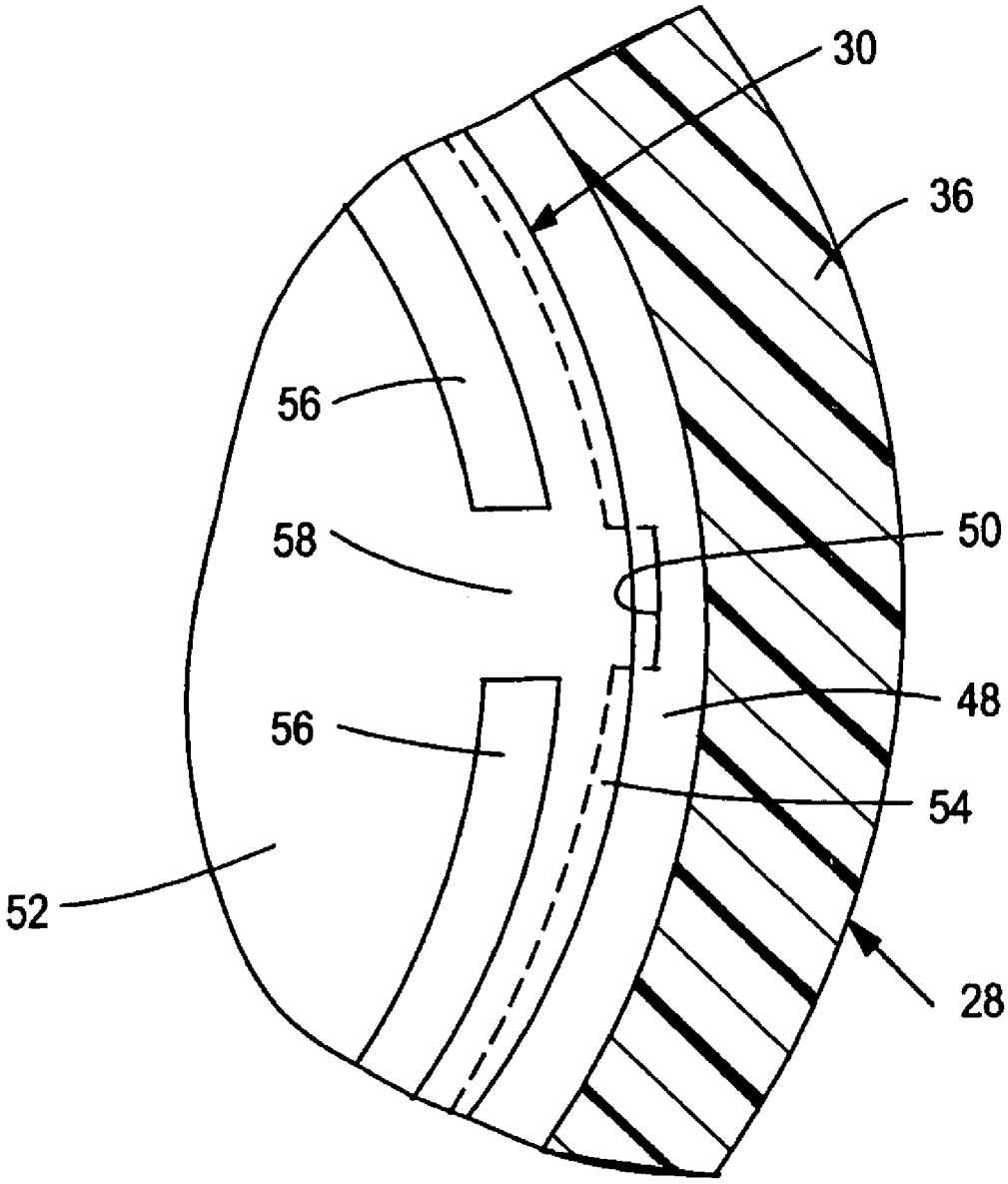
FIG. 3 is a fragmentary sectional view taken substantially along the line 3-3 in FIG. 2.

Disk 30 is disposed within closure shell 28 separate from shell base wall 34 and generally perpendicular to the axis of closure skirt 36. Disk 30 includes a generally flat disk body 52 having a periphery 54, preferably circular, captured between ledge 48 and base wall 34 of closure shell 28. Disk periphery 54 preferably is loosely captured between ledge 48 and base wall 34 so that disk 30 (with liner 32) is free to rotate with respect to the closure shell. Spacer elements are disposed on the upper surface of disk body 52 for engagement with the opposing undersurface of closure shell base wall 34. In the illustrated embodiment of the disclosure, these spacer elements are in the form of circumferentially aligned angularly spaced arcuate, preferably part-circular, bead segments 56 (FIG. 3) integrally upwardly extending from the upper surface of disk body 52. There is at least one gap 58, and preferably a plurality of angularly spaced gaps 58, formed between the opposing ends of bead segments 56. Bead segments 56 thus engage the undersurface of base wall 34 so as to space disk body 52 from the base wall undersurface. FIG. 3 illustrates a gap 58 in radial alignment with a drain slot 50 in ledge 48 by way of example. However, inasmuch as disk 30 (with liner 32) is free to rotate with respect to closure shell 28, gaps 58 often will not be aligned with drain slots 50 as shown in FIG. 3.

Sealing liner 32 preferably is flexible and resilient, and is disposed on the undersurface of disk body 52. Liner 32 preferably is molded in situ onto disk 30. This liner molding operation preferably is accomplished in a two-material injection molding operation, in which disk 30 is first injection molded and liner 32 is then injection molded onto the undersurface of the disk. However, in accordance with the broadest aspects of the present disclosure, liner 32 could be injection or compression molded onto disk 30 in a separate molding operation, or could be compression molded onto disk 30 after disk 30 is assembled to shell 28. Liner 32 may be of any suitable material construction. In accordance with the preferred embodiments of the disclosure, liner 32 is of resin construction, and most preferably includes a barrier material to resist permeation of gases, water vapor and/or flavorants through the liner. The liner most preferably is provided in accordance with the disclosure of one of the U.S. Pat. Nos. 6,371,318 and 6,399,170 noted above. Other suitable barrier liners or non-barrier liners alternatively may be employed.

Closure shell 28 and disk 30 preferably are of relatively rigid molded plastic construction, such as polypropylene, and may be fabricated in suitable injection or compression molding operations. As noted above, it is preferred, but not essential, that disk 30 and liner 32 be fabricated in a two-material injection molding operation. Container 22 may be of glass or plastic construction.

After container 22 has been filled with product, typically a fluid product, closure 26 is applied over the neck finish of the container. Rotation of closure shell 28 to engage thread segments 38, 40 pushes disk 30 and liner 32 against the axial end of the container neck finish. In the illustrated exemplary embodiment of the disclosure, container neck finish 24 terminates in a trim flange 60 that extends radially inwardly and axially upwardly from the neck finish. This flange is a vestige of a trimming operation after extrusion blow molding a plastic container. Liner 32 is pressed into sealing engagement with flange 60. A peripheral ring 62 may be provided on disk 30 slidably to engage the outside surface of the container neck finish to help align disk 30 and liner 32 with the axis of the container neck finish. Inasmuch as disk 30 and liner 32 are loosely retained within closure shell 28, disk 30 and liner 32 do not rotate with respect to the container finish after engagement with the finish, but merely are axially pressed onto the container neck finish as shell 28 is tightened onto the neck finish. This helps reduce scarring of the liner during closure application and removal.

After the closure has been applied to the container neck finish, flushing fluid such as air or water may be directed into opening 46 of closure base wall 34, and into the area between the upper surface of disk body 52 and the undersurface of base wall 34. This flushing fluid travels radially outwardly through the area between the disk and the closure base wall, through the gaps 58 between bead segments 56, around the outer peripheral edge of disk 30, through drain slots 50 in ledge 48, and then downwardly between the inside surface of skirt 36 and the outside surface of neck finish 24. This flushes any debris or product residue from between the closure base wall and the disk, and from between the closure skirt and the container neck finish, and helps prevent buildup of product, debris and/or mold in these areas. To remove the closure, the closure shell is rotated in a removal direction, usually counterclockwise with respect to the container neck finish. As the closure shell is unthreaded, ledge 48 on closure skirt 36 engages and lifts disk periphery 54 so as to lift liner 32 out of sealing engagement with the end of the neck finish. The dimensional relationships of the closure and the container, the compressibility of liner 32, and the flexibility of trim flange 60 preferably are such that tamper-indicating band 42 (FIG. 1) is frangibly separated from skirt 36 before the seal is broken between liner 32 and finish flange 60.

There thus have been disclosed a closure, a closure and container package, and a method of manufacture that fully satisfy all of the objects and aims previously set forth. The closure and package possess superior sealing capabilities, particularly in high-temperature applications such as hot-fill, pasteurization and retort applications. The closure and package are adapted to be flushed with fluid, after filling and application of the closure, to remove debris and any excess fluid product that may result from the filling operation. The disclosure has been presented in conjunction with an exemplary embodiment, and a number of modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A plastic closure that includes:

a plastic closure shell having a base wall with a central opening, a skirt for securing the closure to a container neck finish and an internal ledge on said skirt adjacent to but spaced from said base wall, a plastic disk retained within said shell, said plastic disk including a plurality of axially extending spacer elements around said disk to engage an underside of said base wall and space said disk from said base wall of said shell, angular gaps between said spacer elements to permit flow of fluid from said central opening, between said base wall and said disk and through said gaps, and a periphery of said disk disposed between said internal ledge and said base wall to capture said disk within said shell such that said disk is free to rotate within said shell, and a resilient sealing liner molded on an underside of said disk for sealing engagement with a container neck finish.

2. The closure set forth in claim 1 wherein said spacer elements comprise a plurality of angularly spaced circumferentially aligned bead segments around a peripheral portion of said disk.

3. The closure set forth in claim 1 wherein said internal ledge on said skirt has at least one radially inwardly opening axially extending drain slot to permit flow of fluid past said internal ledge between said periphery of said disk and said skirt.

4. The closure set forth in claim 1 wherein said closure shell includes a tamper band frangibly connected to an edge of said skirt remote from said base wall.

5. A two-piece plastic closure that includes:

a plastic closure shell having a base wall with a central opening, a skirt for securing the closure to a container neck finish, an internal ledge on said skirt adjacent to but spaced from said base wall, and at least one radially inwardly opening axially extending drain slot in said ledge, and a plastic disk loosely retained within said shell, said disk including an axially extending bead composed of a plurality of angularly spaced arcuate bead segments around a peripheral portion of said disk to space said disk from said base wall of said shell, a resilient sealing liner molded onto an underside of said disk for sealing engagement with a container neck finish, and a periphery disposed between said internal ledge and said base wall to capture said disk within said shell such that said disk is free to rotate within said shell.

6. The closure set forth in claim 5 wherein said closure shell includes a tamper band frangibly connected to an edge of said skirt remote from said base wall.

7. A closure and container package that includes:

a container having a neck finish with at least one external thread segment, and a closure that includes:

a plastic closure shell having a base wall with a central opening, a skirt with at least one internal thread segment engaged with said at least one external thread segment securing said closure to said container neck finish and an internal ledge on said skirt adjacent to but spaced from said base wall, a plastic disk retained within said shell, said plastic disk including a plurality of axially extending spacer elements around said disk to engage an underside of said base wall and space said disk from said base wall of said shell, angular gaps between said spacer elements to permit flow of fluid from said central opening, between said base wall and said disk and through said gaps, and a periphery of said disk disposed between said internal ledge and said base wall to capture said disk within said shell such that said disk is free to rotate within said shell, and a resilient sealing liner molded on an underside of said disk and being in sealing engagement with said container neck finish.

8. The package set forth in claim 7 wherein said spacer elements comprise a plurality of angularly spaced circumferentially aligned bead segments around a peripheral portion of said disk.

9. The package set forth in claim 7 wherein said internal ledge on said skirt has at least one radially inwardly opening axially extending drain slot to permit flow of fluid past said internal ledge between said periphery of said disk and said skirt.

10. The package set forth in claim 7 wherein said neck finish includes a radially inwardly extending trim flange in sealing engagement with said liner.

11. The package set forth in claim 10 wherein said closure shell includes a tamper band frangibly connected to an edge of said skirt remote from said base wall.

12. The package set forth in claim 11 wherein flexibility of said trim flange and compressibility of said liner are such that said tamper band is frangibly separated from said skirt before sealing is lost between said liner and said trim flange upon removal of said closure from said neck finish.

* * * * *

UNITED STATES PATENT AND TRADEMARK OFFICE

CERTIFICATE OF CORRECTION

PATENT NO. : 7,611,026 B1
APPLICATION NO. : 11/150373
DATED : November 3, 2009
INVENTOR(S) : Bloom et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1100 days.

Signed and Sealed this

Twelfth Day of October, 2010

David J. Kappos

David J. Kappos
*Director of the United States Patent and Trademark Office*